US006729296B2

(12) United States Patent
King

(10) Patent No.: US 6,729,296 B2
(45) Date of Patent: May 4, 2004

(54) VARIABLE VANE ROTARY ENGINE

(76) Inventor: Matthew Brandon King, 9609 84th Avenue Ct. NW., Gig Harbor, WA (US) 98332

( * ) Notice: Subject to any disclaimer, the term of this patent is extended or adjusted under 35 U.S.C. 154(b) by 0 days.

(21) Appl. No.: 10/348,432

(22) Filed: Jan. 21, 2003

(65) Prior Publication Data

US 2003/0159673 A1 Aug. 28, 2003

Related U.S. Application Data

(60) Provisional application No. 60/359,217, filed on Feb. 22, 2002.

(51) Int. Cl.[7] ..... F02B 53/00

(52) U.S. Cl. ..... 123/243; 123/241; 123/236; 418/260; 418/268

(58) Field of Search ..... 123/243, 241, 123/236; 418/260, 268

(56) References Cited

U.S. PATENT DOCUMENTS

| | | | | | |
|---|---|---|---|---|---|
| 810,366 | A | * | 1/1906 | Bartoletti | 418/260 |
| 3,747,573 | A | * | 7/1973 | Foster | 123/243 |
| 4,072,132 | A | * | 2/1978 | Lindros | 123/241 |
| 4,106,472 | A | * | 8/1978 | Rusk | 123/243 |
| 4,241,713 | A | * | 12/1980 | Crutchfield | 123/243 |
| 4,990,074 | A | * | 2/1991 | Nakagawa | 418/268 |
| 5,261,365 | A | * | 11/1993 | Edwards | 123/241 |
| 5,277,158 | A | | 1/1994 | Pangman | |
| 5,537,974 | A | * | 7/1996 | Palmer | 123/236 |
| 5,540,199 | A | | 7/1996 | Penn | |
| 6,003,486 | A | | 12/1999 | Vanmoor | |
| 6,125,814 | A | | 10/2000 | Tang | |
| 6,431,139 | B1 | * | 8/2002 | Huttlin | 123/241 |

FOREIGN PATENT DOCUMENTS

| | | | | |
|---|---|---|---|---|
| FR | 1 255 205 | * | 1/1961 | 123/241 |
| IT | 248528 | * | 2/1926 | 418/260 |

* cited by examiner

*Primary Examiner*—Thomas Denion

(57) ABSTRACT

An improved rotary engine that harmoniously produces multiple, sequential cycles. A main housing is comprised of a concentric stator sandwiched between a front and an aft wall enclosing a cylindrical inner space. A network of combustors are stationed about the stator periphery. Mounted on a central axis within the inner space is a concentrically revolving rotor body. The combustors sequentially introduce a working fluid into a plurality of expansion chambers symmetrically stationed within the rotor body. As the rotor is propelled by the working fluid, a variable vane transversely mounted within each expansion chamber simultaneously performs work on a fluid in a compression region. The compressed fluid of each cycle is discharged and diverted to compliment the combustor of a sequential cycle. A high degree of power and efficiency is achieved using simple mechanics to produce multiple cycles during each revolution.

4 Claims, 8 Drawing Sheets

VARIABLE VANE ROTARY ENGINE

CROSS REFERENCE TO RELATED APPLICATIONS

This application is entitled to the benefit of Provisional Patent Application Ser. No. 60/359,217 Filed Feb. 22, 2002.

FEDERAL SPONSORED RESEARCH

Not Applicable

SEQUENCE OR LISTING PROGRAM

Not Applicable

BACKGROUND OF THE INVENTION

1. Field of the Invention

This invention relates to rotary combustion engines and more specifically radial or rotary vane combustion engines that achieve sequential and simultaneous combustion.

2. Background of the Invention

Rotary engines have been recognized as having advantages over reciprocating engines by their superior inertial economy of fewer parts moving in a more concentric pattern about the torque axis. Most rotary designs dispose of parts that contribute to engine load and friction such as valves drive components and large components associated with translating torque to the crankshaft. The inherent simplicity of rotary engines contributes to a much smoother operation and the ability to achieve higher operating frequencies than reciprocating engines. Another great advantage of rotary engines is the ability to accomplish multiple sequential cycles in one revolution as opposed to Otto or Diesel cycles, which require the wasteful dynamics of an extra revolution to evacuate exhaust. These advantages cumulatively increase the volume of processed combustibles in a rotary engine relative to their displacement and proportionally increase their power to weight ratio. However, rotary and radial vane engines have several deficiencies related to the division of cycle processes performed by rotor apex or radial vane seals. These sealing components are exposed to high surface velocities and the extreme heat of rapid combustion concentrated in a relatively small thermal core. Another disadvantage of rotary engines is the relatively small mixing region used for creating a stoichiometric ratio before ignition. This is further complicated by the extremely short interval that combustibles must ignite in a region of varying geometry then expelled into an exhaust cycle incompletely burned.

This invention retains the above stated advantages of rotary and radial vane rotary engines but eliminates those problematic features mentioned. It accomplishes this by the application of expansion chambers that totally encase variable vanes within the rotor body. This configuration uniquely performs the power and compression cycle simultaneously by using the variable vane as a barrier between the working fluid and the inlet air. The inlet air, which is introduced through rotatably aligned rotor and housing inlets, floods the expansion chambers during the intake-exhaust cycle process. Air that enters the forward region of the expansion chamber is trapped by the vane, then compressed during the power-compression cycle and combined with fuel in a combustor of a sequential cycle.

The first notable distinction of this invention from most prior art is that stator inner walls are concentric, not radially asymmetric, and the rotor revolves concentrically about the main axis. This invention abandons the use of elliptical or asymmetrical chambers to facilitate compression through positive displacement between the rotor and stator as described in prior art by Pangman (U.S. Pat. No. 5,277,158), Penn (U.S. Pat. No. 5,540,199), and Tang (U.S. Pat. No. 6,125,814). These methods require vanes to move radially outward and retract into the rotor in order to seal the varying void between the stator and rotor and divide each cycle process. This invention also departs from such methods without the need of stator mechanics that seal to fixed radial vanes and divide the cycle processes such as those employed by Vanmoor (U.S. Pat. No. 6,003,486).

In contrast, the variable vanes in this invention never come in contact or have to seal to the stator inner walls, as they are totally encased within interior expansion chambers. Sealing tolerances are not as critical as is in other rotary engines because combustive gases that breach the variable vane periphery do not greatly effect the compression of the chamber. Quite uniquely, they contribute to the compression region pressure until the two voids reach equilibrium. It is also important to note that the power-compression cycle occurs in such a short interval, only negligible combustive gases achieve this breach and subsequent combustion of the compressed air is not affected.

As stated above, many problems are associated with cooling and thermodynamic losses in rotary engine designs. The cooling problems are associated with the fact that most rotary engine designs take advantage of superior balancing and achieve higher operating frequencies while performing multiple cycles per rotation. Because of the relatively small thermal core of a rotary engine relative to the power produced, the need to remove excess heat is essential to the preservation of the internal parts. In the prescribed method of this invention, inlet air moves freely into the thermal core of the rotor via rotatably aligned housing inlets. A large percentage of the air passes through the expansion chamber and facilitates rotor cooling while expelling exhaust gas. The remainder of the air is trapped by the variable vane in the forward compression region of the expansion chamber where it is compressed and discharged through diffuser ports that recycle heat back into the combustor. This method has the dual advantage of providing inner cooling while reclaiming some of the thermodynamic losses in a regenerative cycle.

As stated above, this invention employs isolated combustion regions or combustors to achieve concise stoichiometric control in a constant geometric cross-section. This has many advantages over other rotary engines that mix combustibles in smaller, constantly changing geometric combustion regions that contribute to unburned or "wetted" fuel. Another major advantage is that combustors are able to maintain a continuous flame front without the need for ignition timing. Combustors also have multi-fuel compatibility and allow for thermodynamic quenching before the primary combustion region temperatures are exposed to the internal rotor parts. This is an important feature in light of developments in plasma ignition systems that use extreme temperatures to completely burn reluctant or lean mixtures and reduce emissions.

A combustor utilizing a plasma ignition source is perfectly suited for this invention because the internal components are thermally isolated from the extreme temperatures in the combustor.

SUMMARY

It is the object of this invention to provide a rotary engine that is compact, lightweight, and simple to manufacture.

It is an additional object of this invention to provide a rotary engine that achieves improved efficiency and increased fuel economy.

It is also the object of this invention to provide a rotary engine with improved combustion yielding significantly lower emissions.

It is yet another object of this invention to provide a rotary engine that can use a variety of fuels.

In accordance with these objectives, this invention provides a variable vane rotary engine comprising of a concentric housing formed by a stator with front and rear covers enclosing an inner space. Disposed within this inner space is a rotor rotatably mounted on a central axis spaced within close tolerance of the stator inner wall. Inside the rotor are symmetrically positioned expansion chambers each containing a variable vane articulated on a pivot axis. The shape of the expansion chambers voids can best be described as "cheese wedges" with round peripheral edges. The expansion chambers and vanes are exposed to the stator wall via peripheral rotor combustion ducts that enter the rotationally rearward inner wall of each chamber. Positioned at the beginning of each power-compression cycle process section of the stator are combustion ports coupled to a combustor via nozzle. Positioned throughout each intake-exhaust cycle process section of the stator are exhaust ducts.

Torque is produced when the combustors discharge their working fluid into the expansion chamber providing rotational energy to the rotor. The variable vanes, precisely controlled as the cycle progresses, simultaneously compress air brought in during the intake-exhaust cycle process and force this compressed air through rotationally aligned diffuser ports. The compressed air is then routed through a compression plenum to compliment the combustion for a combustor of a sequential cycle. The efficiency of this invention is attributed to the small number of moving parts and their respectively low frictional forces. Additionally, all moving parts rotate about the main shaft axis and contribute to a common moment of torque.

Many combinations of expansion chambers and combustors can be applied to acquire the desired output. This invention can also be constructed with one rotor or a multiple of rotors coupled to the same output shaft. Examples in the embodiment depict a single rotor configuration containing five expansion chambers and two external combustors yielding ten full cycles per revolution. A full cycle is considered to be both the power-compression cycle process and the intake-exhaust cycle process. The total number of cycles per revolution is a multiple of the expansion chambers and the number of combustors.

DRAWING NUMBER REFERENCES

Figure 1:
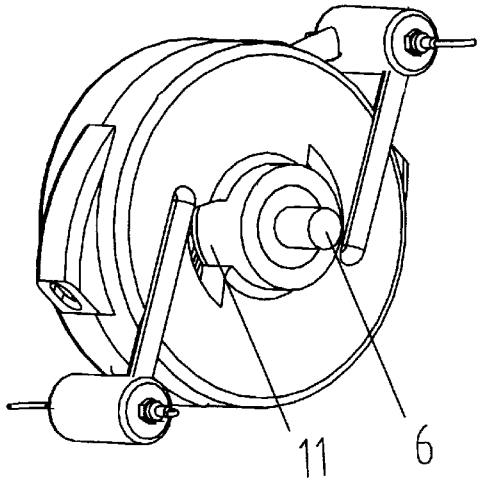
FIGS. 1–1A are front perspective and exploded view of the variable vane rotary engine, according to the embodiment of the invention.
Figure 1A:
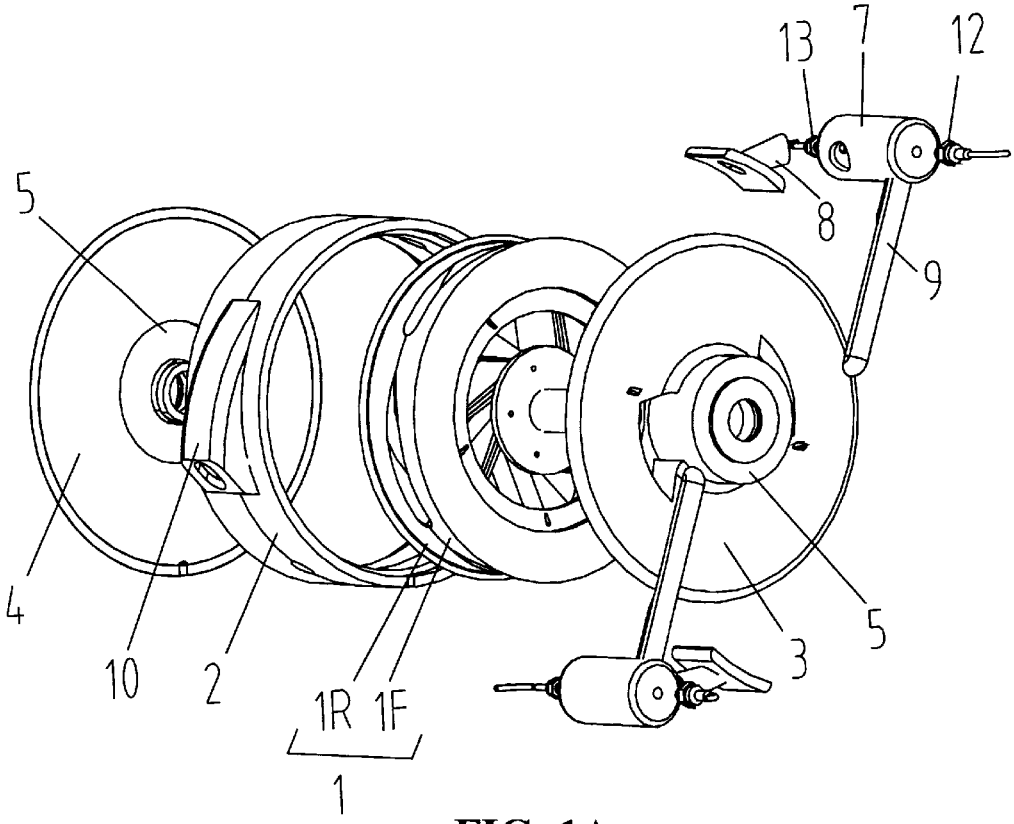

1. rotor, (1F-front half shell, 1R-rear half shell)
2. stator
3. front cover
4. rear cover
5. bearing assembly
6. main shaft
7. combustor, (7T-upper combustor 7B-lower combustor)
8. nozzle
9. compression plenum
10. exhaust duct, (10T-exhaust duct at 90°, 10B-exhaust duct at 270°)
11. housing inlet
12. fuel atomizer
13. igniter
14. rotor seal
15. expansion chamber (15A–E; five chambers)
16. peripheral rotor combustion duct
17. vane
18. vane shaft
19. limit bearing
20. command bearing
21. limiting cam
22. commanding cam
23. rotor inlet
24. diffuser
25. chamber port
26. diffuser inlet
27. oil ports
28. shaft seal
29. oil channel
30. peripheral vane groove
31. stator damn
32. oil drains
33. compressor
34. main axis

DETAILED DESCRIPTION OF THE PREFERRED EMBODIMENT

Figure 2:
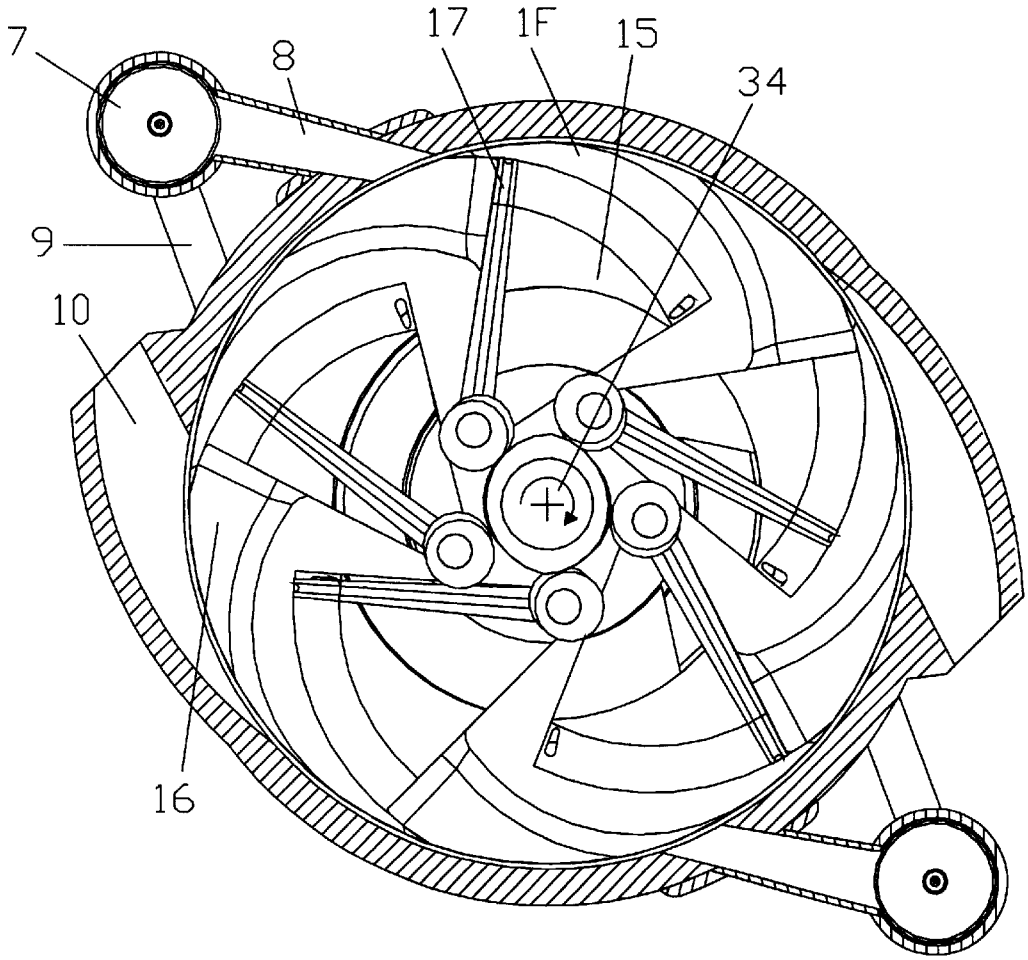
FIG. 2 is a partial view of the inner parts with the rear rotor shell removed within a sectioned housing and external components.
Figure 3:
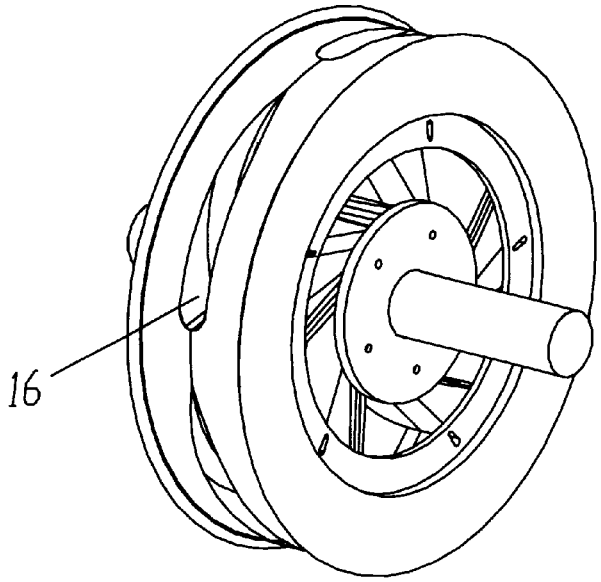
FIGS. 3–3A is a perspective and exploded view of the rotor components.
Figure 3A:
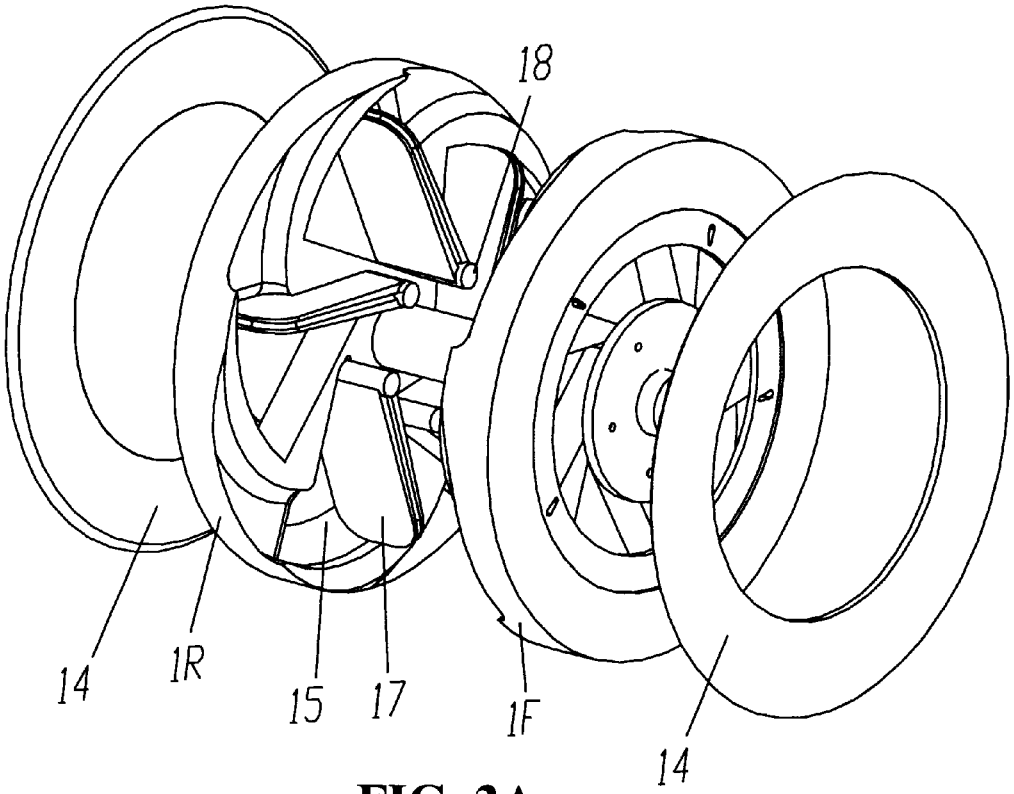
Figure 4:
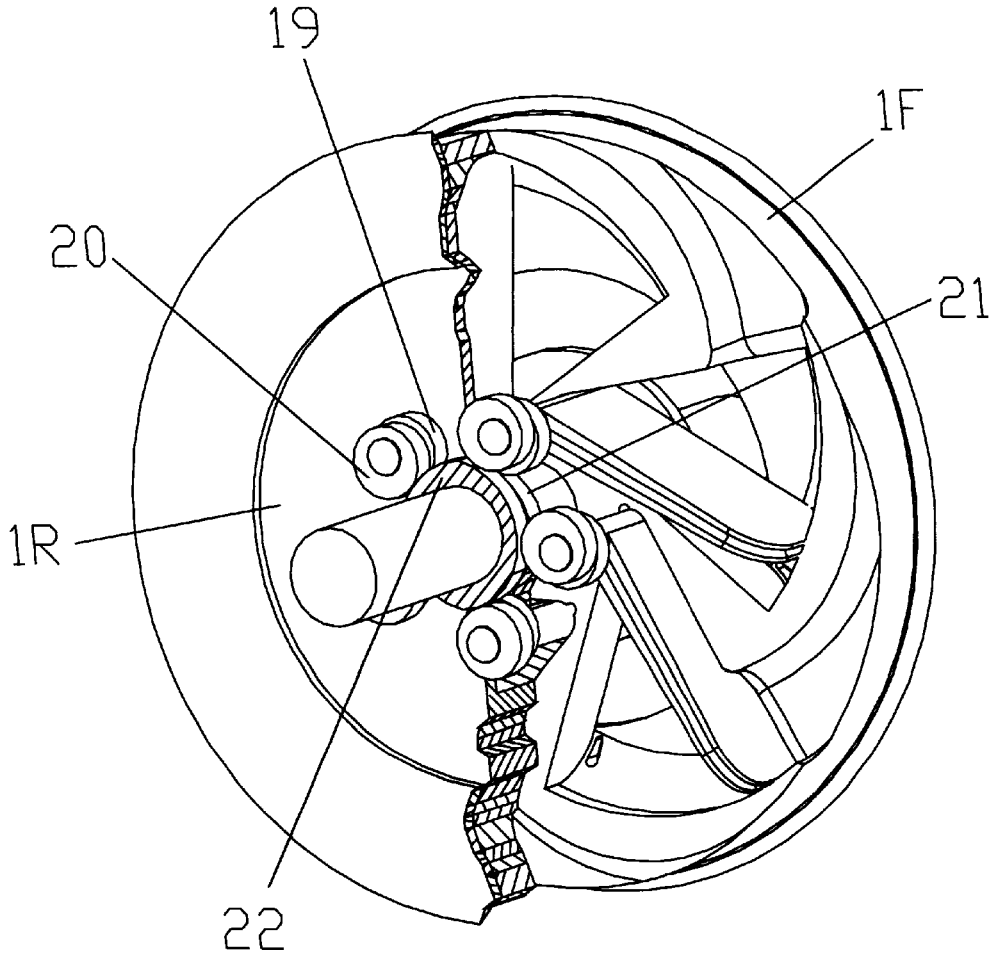
FIG. 4 is a partial perspective view of the variable vane articulating mechanics through a broken rear rotor shell.
Figure 5:
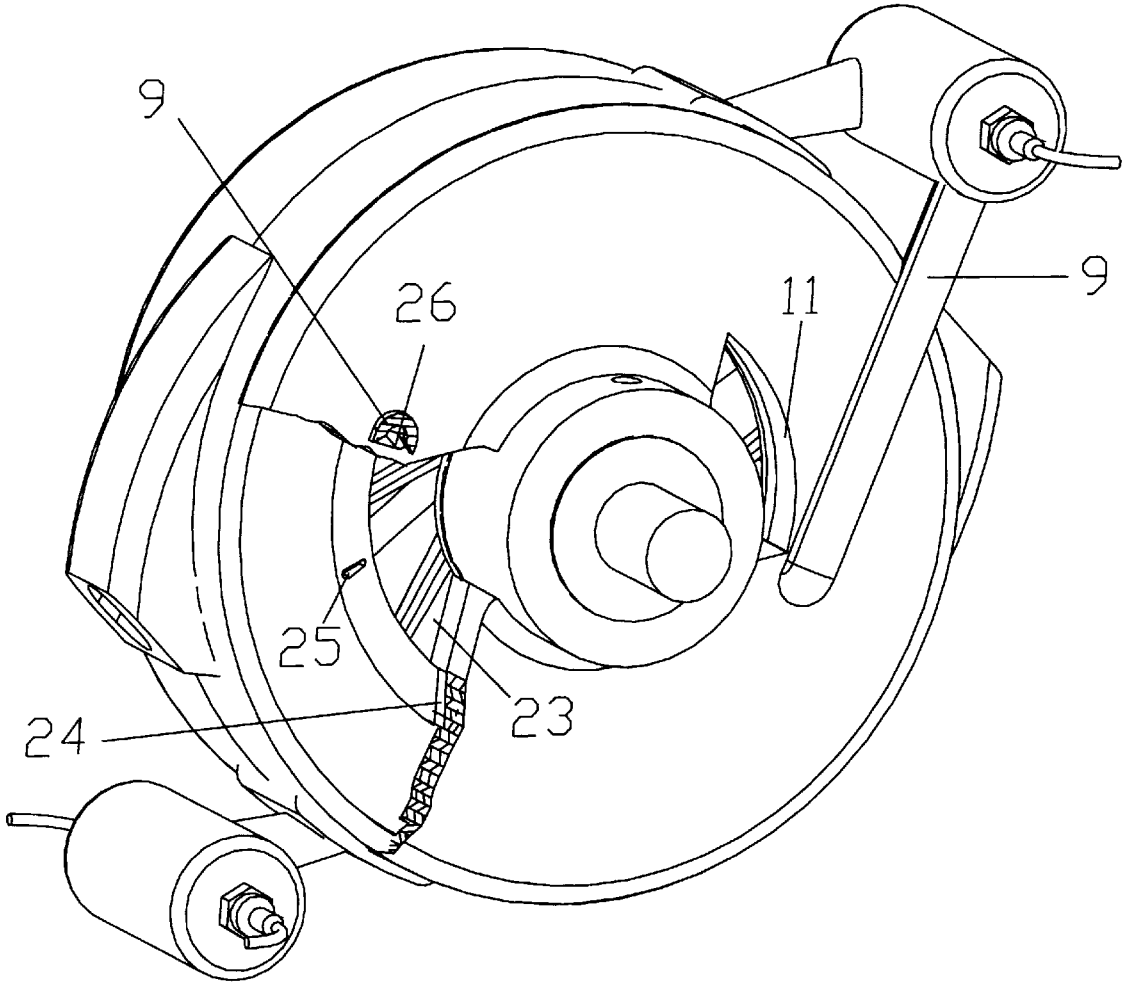
FIG. 5 is a partial perspective view though a broken housing of the diffuser and rotor chamber porting.

With reference to FIGS. 1–2, a variable vane rotary engine includes a rotor (1) that rotates within the inner space of an external housing. The main body of the rotor (1) is formed by a front shell (1F) and a rear shell (1R). The external housing consist of a stator (2) enclosed by a front cover (3) and a rear cover (4) each containing a bearing assembly (5) supporting a main shaft (6). Positioned around the stator (2) are a pair of combustors (7) that discharge a working fluid through passages in the stator (2) via nozzle (8). Positioned about the housing is a compression plenum (9), a pair of exhaust ducts(10), and a pair of housing inlets (11). Each combustor (7) has a fuel atomizer (12) and an igniter (13).

The rotor (1) rotates concentrically within the inner walls of the stator (2) and is fenced on each side by a rotor seal (14). The rotor (1) contains five interior expansion chambers 15) the shape of cylindrical-sectors with round peripheral edges. The expansion chambers (5), symmetrically positioned about the rotor (1) main axis (34), are pitched forward resulting in the peripheral inner wall converging inward in the direction of rotation.

With reference to FIGS. 2–5, each expansion chamber (15) has a peripheral rotor combustion duct (16) which, from the rotationally-rearward expansion chamber (15) wall, expose the expansion chamber (15) void and allow combustibles to enter and exit the rotor (1). Each of the expansion chambers (15) encase a variable vane (17) transversely mounted within the rotor (1) on a vane shaft (18). The vanes (17) pivot in a sweeping motion within their respective expansion chambers (15). The articulation of the vane (17) is controlled by an eccentric limit bearing (19) and an eccentric command bearing (20) that follow a limiting cam (21) and commanding cam (22) respectively. This ensures optimal vane (17) positioning during each cycle process under varying loads however, the command bearing (20) and commanding cam (22) are essential only in designs that call for articulation of the vane (17) during negative torque loads.

The front lateral inner wall of each expansion chamber (15) is partially exposed to the front cover (3) inner wall by a rotor inlet (23) concentrically cutout of the front rotor shell (1F) lateral wall. During each intake-exhaust cycle process, the rotor inlets (23) are exposed to the housing inlets (11) allowing for the passage of air through the front cover (3). During each power-compression cycle process, the expansion chambers (15) are sealed when the rotor inlet (23) void is displaced by a diffuser (24) protruding from the front cover (3) inner wall. The air is then compressed by the vane (17) and forced out of the expansion chamber (15) through a chamber port (25) that rotatably aligns with a diffuser inlet (26) located on each diffuser (24). Each diffuser inlet (26) is coupled to a compression plenum (9). The positioning of the diffuser inlet (26) relative to the rotor rotation through the power-compression cycle process determines the amount of compression that occurs before the air is discharged. This design consideration is also applied to the rate at which the vanes (17) are articulated relative to the rotor (1) rotation during the cycle progression.

Figure 6:
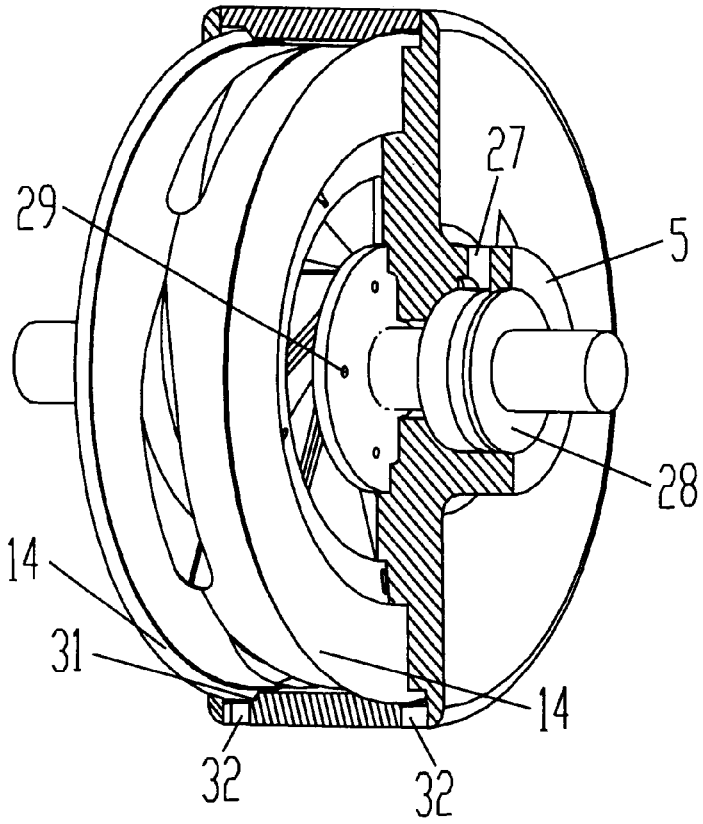
FIGS. 6–6A is a partial sectional view of the housing with the interior components shown complete to illustrate lubrication flow further detailed by a broken view of the rear rotor shell supporting a variable vane.
Figure 6A:
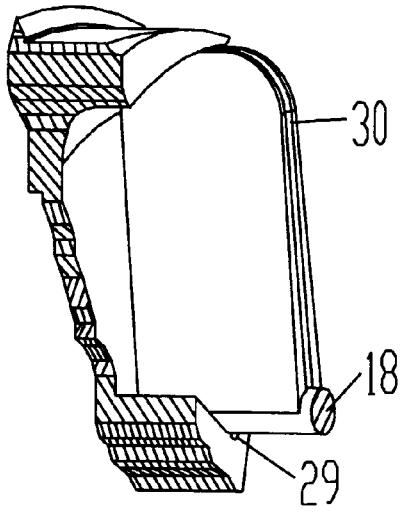

With reference to FIG. 6, lubrication is supplied to the housing internal parts by a pressurized system which introduces oil through both shaft bearing assemblies (5) via an oil port (27) while being contained by an outboard shaft seal (28). Lubrication is provided to each vane shaft (18) by an oil channel (29) that collects incoming oil then passes it beneath the vane shaft (18) and deposits it on the rear side of the rotor. Because the vanes (17) pass without actually touching the expansion chamber (15) walls, no lubrication is introduced into the interior expansion chambers (15). The working fluid pressure in the expansion chamber (15) is sealed off by a peripheral vane groove (30) which creates a boundary region allowing only negligible blow-back gases to breach into the compression region. Oil is prevented from entering onto the stator (2) inner wall by the action of the rotor seals (14) fencing a stator damn (31). The oil that forms within the inner walls of the housing gets evacuated by a scavenge system through a pair of oil drains (32).

Theory of Operation (Note: Because components (15) and (7) detailed in the contents below are plural, and alpha designator has been appended to their standard numbering for clarification.)

Figure 7A:
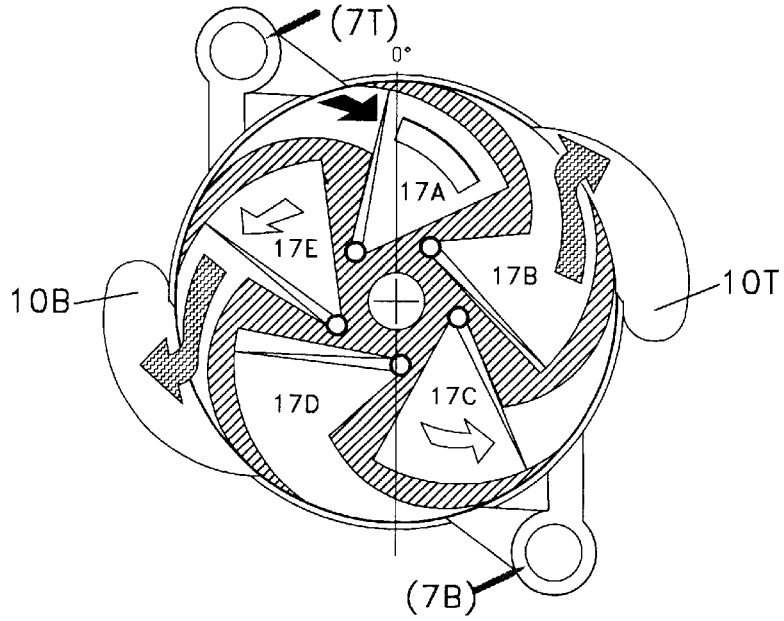
FIGS. 7A–7B is an informal illustration depicting the theory of operation.
Figure 7B:
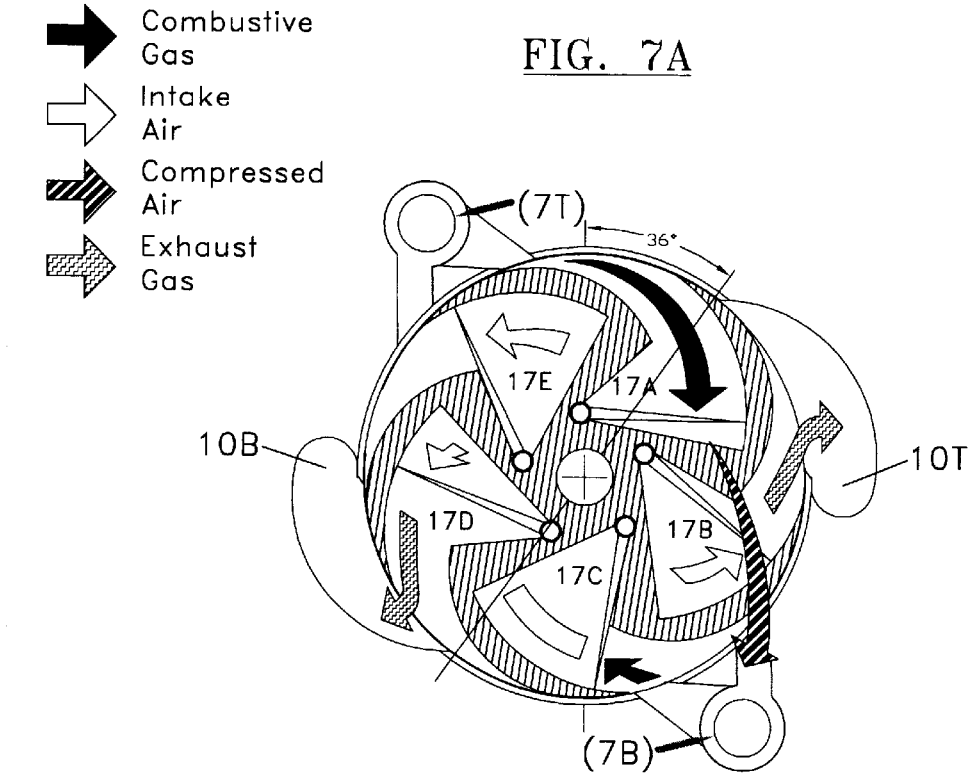

With reference to FIG. 2 and FIGS. 7A–B, the start cycle is initiated by introducing compressed air into both combustors to begin the rotor rotation as depicted in FIG. 7A. Once the start cycle is completed, we refer to the top expansion chamber (15A) stationed at the beginning of its cycle at 0°. The expanding gas is discharged out of the combustor (7T) (top cycle) into expansion chamber (15A). The vane (17) in expansion chamber (15A) acts as a barrier between the working fluid discharged from combustors (7T) and the intake air side ducted into expansion chamber (15A) during the exhaust intake cycle as is currently the case with expansion chamber(15C, 15E and 15B). Note, expansion chamber (15D) is still in mid power-compression cycle process under the influence of combustor (7B). While creating torque, vane (17A) is simultaneously compresses the inlet air on the enclosed side of expansion chamber (15A). This compressed air is ducted into combustor (7B) (bottom cycle) via compression plenum(9).

As depicted in FIG. 7B, the power-compression cycle in expansion chamber (15A) has now complimented combustor (7B) which will provide the combustive force in the power-compression cycle process of expansion chamber (15C). This cycle is repeated with expansion chamber (15C) now complimenting combustor (7T) for the coming power-compression cycle process in expansion chamber (15E) and repeated again sequentially and continuously. The compliment of five expansion chambers (15A–E) with two 180° opposing combustors yields a cycle every 36° of rotation for a total of ten complete cycles per revolution. The intake-exhaust cycle is assisted by a vacuum created in the void of each expansion chamber (15) as each vane (17) returns to its rearward position. The vane (17) dynamics of the intake-exhaust cycle expel the gases from the expansion chamber (15) through the peripheral rotor combustion port (16) and outward through the exhaust ducts (10T,B). This task is aided by the influx of air during the intake-exhaust cycle under influences of centrifugal force.

Figure 8:
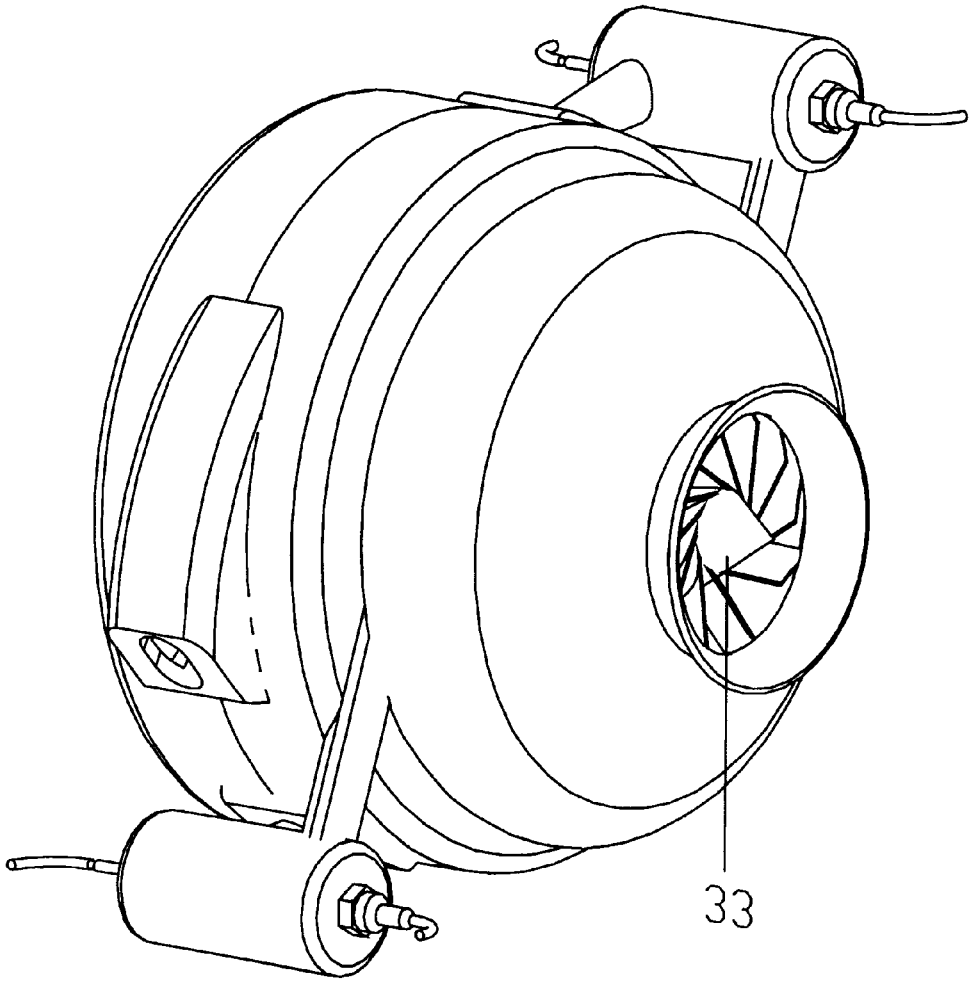
FIG. 8 is a front perspective view of the variable vane rotary engine with the addition of a shaft drive compressor.

With reference to FIG. 8, the total cycle efficiency can be significantly improved by the aid of a shaft or exhaust(not shown) driven compressor (33) used to elevate inlet air pressure.

As demonstrated in the description, this invention is very unique. It accomplishes the complex tasks of executing all cycle processes with a simple structure performing very simple mechanical techniques to achieve a substantial power-to-weight ratio advantage over conventional reciprocating engines. In addition, it accomplishes these tasks utilizing efficient methods of creating torque while addressing the problematic features that plague rotary engines.

Advantages of this invention address the future power application requirements of large and small engines in any category. This versatility extends from small single rotor application in hybrid vehicles, to large multi-rotor applications in trucks, marine vessels, aircraft, or any application projected beyond the endurance of fuel cells. This invention targets the future energy and emission standards that demand all combustion engines dramatically improve their efficiency while reducing emissions.

Although the description above describes many specificities, these should not be construed as limiting the scope of the invention, as many mechanical variations and structural modifications can be made therein without departing from the spirit of the invention. For example, many variations in the rotor porting, housing inlets, expansion chamber shape, as well as the number of expansion chambers and combustors can be considered to achieve similar results.

Thus the scope of the invention should be determined by the appended claims and their legal equivalents, rather than the examples given.

I claim:

1. An improved variable vane rotary engine comprising:

a) a housing formed by a stator having a cylindrical inner wall surface enclosed by a pair of side covers; wherein said housing forms an inner space;

b) a rotor having a generally concentric periphery rotatably supported within said inner space and sharing a main axis with said housing;

c) said stator having a plurality of combustion inlets each for delivering a working fluid from a combustor though a wall of said stator; wherein each of said combustors are rotatably positioned at the beginning of a power-compression section of said stator corresponding to a power-compression cycle process;

d) said stator having a plurality of exhaust ducts passing through the wall of said stator; wherein each of said exhaust ducts are rotatably positioned on an intake-exhaust section of said stator corresponding to an intake-exhaust cycle process;

e) said rotor having a plurality of expansion chambers rotatably symmetrical with respect to said main axis; wherein each of said expansion chambers has a peripheral rotor combustion duct for delivering said working fluid into said rotor;

f) a variable vane enclosed within each of said expansion chambers transversely supported on a pivotal axis by a variable vane shaft; wherein each of said variable vanes forms an enclosed compression region within each of said expansion chambers;

g) a means of engaging each of said variable vane shafts to control the pivotal articulation of said variable vanes during each of said power-compression cycle processes and each of said intake-exhaust cycle processes;

h) said housing having one or more air inlets for delivering air into said inner space;

i) an ingressing means disposed on said rotor for receiving air from said inner space into each of said expansion chambers during each of said intake-exhaust cycle processes;

j) a sealing means disposed on said rotor for obstructing exposure to each of said expansion chambers from air in said inner space during each of said power-compression cycle processes;

k) a diverting means for delivering air discharged from said compression region during each of said power-compression cycle processes, which is utilized by one of said combustors in a sequential cycle;

l) a fuel introduction means and an ignition means disposed on said combustor for producing a working fluid.

2. The variable vane rotary engine as cited in claim 1, a means for driving a compression stage powered by said variable vane rotary engine whereby elevating inlet air pressure during each of said intake-exhaust cycle processes.

3. The variable vane rotary engine as cited in claim 1, wherein said variable vane rotary engine is constructed using a plurality of said rotors coupled to a main shaft.

4. The variable vane rotary engine as cited in claim 1, wherein each of said combustors are integrally formed with said stator.

* * * * *